US009901170B2

(12) United States Patent
Tam

(10) Patent No.: US 9,901,170 B2
(45) Date of Patent: Feb. 27, 2018

(54) KEYLESS LOCKING TOOL CHEST

(71) Applicant: Cze-Chao Tam, Palos Verdes, CA (US)

(72) Inventor: Cze-Chao Tam, Palos Verdes, CA (US)

( * ) Notice: Subject to any disclaimer, the term of this patent is extended or adjusted under 35 U.S.C. 154(b) by 0 days.

(21) Appl. No.: 14/687,092

(22) Filed: Apr. 15, 2015

(65) Prior Publication Data

US 2016/0303732 A1 Oct. 20, 2016

(51) Int. Cl.

| | |
|---|---|
| ***E05B 65/46*** | (2017.01) |
| ***E05C 9/10*** | (2006.01) |
| ***A47B 81/00*** | (2006.01) |
| ***B25H 3/02*** | (2006.01) |
| ***E05B 65/462*** | (2017.01) |
| ***E05B 37/02*** | (2006.01) |

(52) U.S. Cl.
CPC ..... *A47B 81/00* (2013.01); *B25H 3/028* (2013.01); *E05B 37/02* (2013.01); *E05B 65/462* (2013.01)

(58) Field of Classification Search
CPC ..... B25H 3/022; A47B 67/04; A47B 81/00; E05B 65/462; E05B 65/463–65/468
USPC ..... 312/216, 218, 219, 215, 217, 220
See application file for complete search history.

(56) References Cited

U.S. PATENT DOCUMENTS 1,318,011 A * 10/1919 Schiavone ..... E05B 65/462 312/219
1,716,274 A * 6/1929 Jones ..... E05B 65/462 312/217
1,847,106 A * 3/1932 Turner ..... E05B 65/462 312/194
2,829,021 A * 4/1958 Wolters ..... E05B 65/462 109/59 R
2,884,778 A * 5/1959 Shmorhun ..... E05B 37/08 312/218
3,767,280 A * 10/1973 McLaughlin ..... E05B 65/462 312/219
4,441,767 A * 4/1984 Stark ..... E05B 65/464 312/107.5
4,637,667 A * 1/1987 Reid ..... E05B 65/463 312/216
5,661,991 A * 9/1997 Hsu ..... E05B 37/02 70/312
5,946,953 A * 9/1999 Feldpausch ..... E05B 65/462 312/219

(Continued)

*Primary Examiner* — Daniel J Troy
*Assistant Examiner* — Timothy M Ayres
(74) *Attorney, Agent, or Firm* — Innovation Capital Law Group, LLP; Vic Lin

(57) ABSTRACT

A keyless locking tool chest has a plurality of drawers that can be locked and unlocked with a keyless lock. The keyless tool chest comprises a plurality of drawers, a keyless lock, a turn dial and a locking mechanism connected to the keyless lock and the turn dial that locks and unlocks the plurality of drawers. The keyless lock comprises a combination lock having a plurality of rotating discs with inscribed numerical notches. The locking mechanism comprises a horizontal bar connected to the keyless lock and the turn dial at its center, and a pair of vertical bars at its ends. Upon entering the correct numerical combination in the keyless lock, the keyless tool chest becomes unlocked, the turn dial becomes rotatable and the horizontal bar becomes movable together with the pair of vertical bars, such that the plurality of drawers can be pulled out of the tool chest.

18 Claims, 10 Drawing Sheets

(56) References Cited

U.S. PATENT DOCUMENTS

| | | | | |
|---|---|---|---|---|
| 6,374,649 | B1 * | 4/2002 | Holcomb | E05B 65/468 312/215 |
| 6,726,294 | B1 * | 4/2004 | Muller | E05B 65/462 312/215 |
| 8,495,898 | B2 * | 7/2013 | Gokcebay | G07C 9/00666 70/214 |
| 8,733,854 | B1 * | 5/2014 | Chang | E05B 65/462 312/107.5 |
| 9,208,628 | B2 * | 12/2015 | Gokcebay | E05C 3/042 |
| 2002/0070640 | A1 * | 6/2002 | Hamilton | E05B 65/467 312/107.5 |
| 2003/0189353 | A1 | 10/2003 | Moore | |
| 2006/0250055 | A1 * | 11/2006 | Liu | B25H 3/028 312/218 |
| 2009/0200350 | A1 | 8/2009 | Brallier et al. | |
| 2009/0200351 | A1 | 8/2009 | Brallier et al. | |
| 2010/0171399 | A1 * | 7/2010 | Zheng | B25H 3/028 312/216 |

* cited by examiner

KEYLESS LOCKING TOOL CHEST

BACKGROUND OF THE INVENTION

1. Field of the Invention

This invention generally relates to a device and a method of providing a keyless locking tool chest.

2. Description of Prior Art and Related Information

The tool boxes and tool chests known in the art typically comprise a plurality of drawers which can be locked and unlocked using a traditional set of keys. The main problem with using traditional keys is that if the keys are lost or stolen, the user will need to replace the entire lock system. Further, the traditional key and lock system does not prevent an unauthorized person from making a duplicate key to open the tool chest.

BRIEF SUMMARY OF THE INVENTION

A current keyless locking tool chest, or simply a keyless tool chest, that embodies the invention described herein provides a tool chest having a plurality of drawers that can be locked and unlocked with a keyless lock. This eliminates the need for traditional keys to lock the tool chest, yet maintains the maximum security of the tool chest by allowing a user to create his or her own secret lock combination and reducing the chance of an unauthorized person using a duplicate key to open the tool chest.

In one aspect, a keyless tool chest comprises a plurality of drawers, a keyless lock and a locking mechanism connected to the keyless lock that locks and unlocks the plurality of drawers. In one embodiment, the keyless lock may comprise a combination lock having a plurality of rotating discs with inscribed numerical notches. In another embodiment, the keyless lock may comprise an electronic keypad wherein a predetermined numerical combination can be entered.

The locking mechanism may further comprise at least a horizontal bar that is connected to the keyless lock and a turn dial at its center, and a pair of vertical bars at its ends. In one preferred embodiment, the locking mechanism may comprise two horizontal bars. The pair of vertical bars is connected to each of the plurality of drawers. In a "locked" configuration, the horizontal bar and the pair of vertical bars are not movable, such that the plurality of drawers cannot be pulled out of the chest. Upon setting the correct numerical combination, either by aligning the numerical notches on the plurality of rotating discs or by entering digital numbers using the electronic keypad, the turn dial becomes rotatable and the horizontal bar becomes movable together with the pair of vertical bars, such that the plurality of drawers can be pulled out of the tool chest.

In yet another aspect, a method of providing a keyless tool chest is provided. The method may comprise providing a plurality of drawers, providing a keyless lock, and providing a locking mechanism that locks and unlocks the plurality of drawers.

The step of providing a keyless lock may comprise providing a combination lock having a plurality of rotating discs with inscribed numerical notches. In another preferred method, this step may comprise providing a combination lock with an electronic keypad.

The step of providing a locking mechanism that locks and unlocks the plurality of drawers may further comprise connecting a horizontal bar to the keyless lock and a turn dial at its center, and connecting the horizontal bar to a pair of vertical bars at the horizontal bar's opposite ends, wherein the pair of vertical bars is connected to each of the plurality of drawers. The step may further comprise setting the correct numerical combination to allow the turn dial to rotate and the horizontal bar to move together with the pair of vertical bars to allow the plurality of drawers to be pulled out of the tool chest.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS

Throughout the specification, positional and directional terms below refer to the following:

"Front" shall refer to the side or direction where a keyless lock and a plurality of drawers are located.

"Back" or "Rear" shall refer to the side or direction away from the keyless lock and the plurality of drawers.

"Right" shall refer to the right side or direction when viewed from the front.

"Left" shall refer to the left side or direction when viewed from the front.

Figure 1:
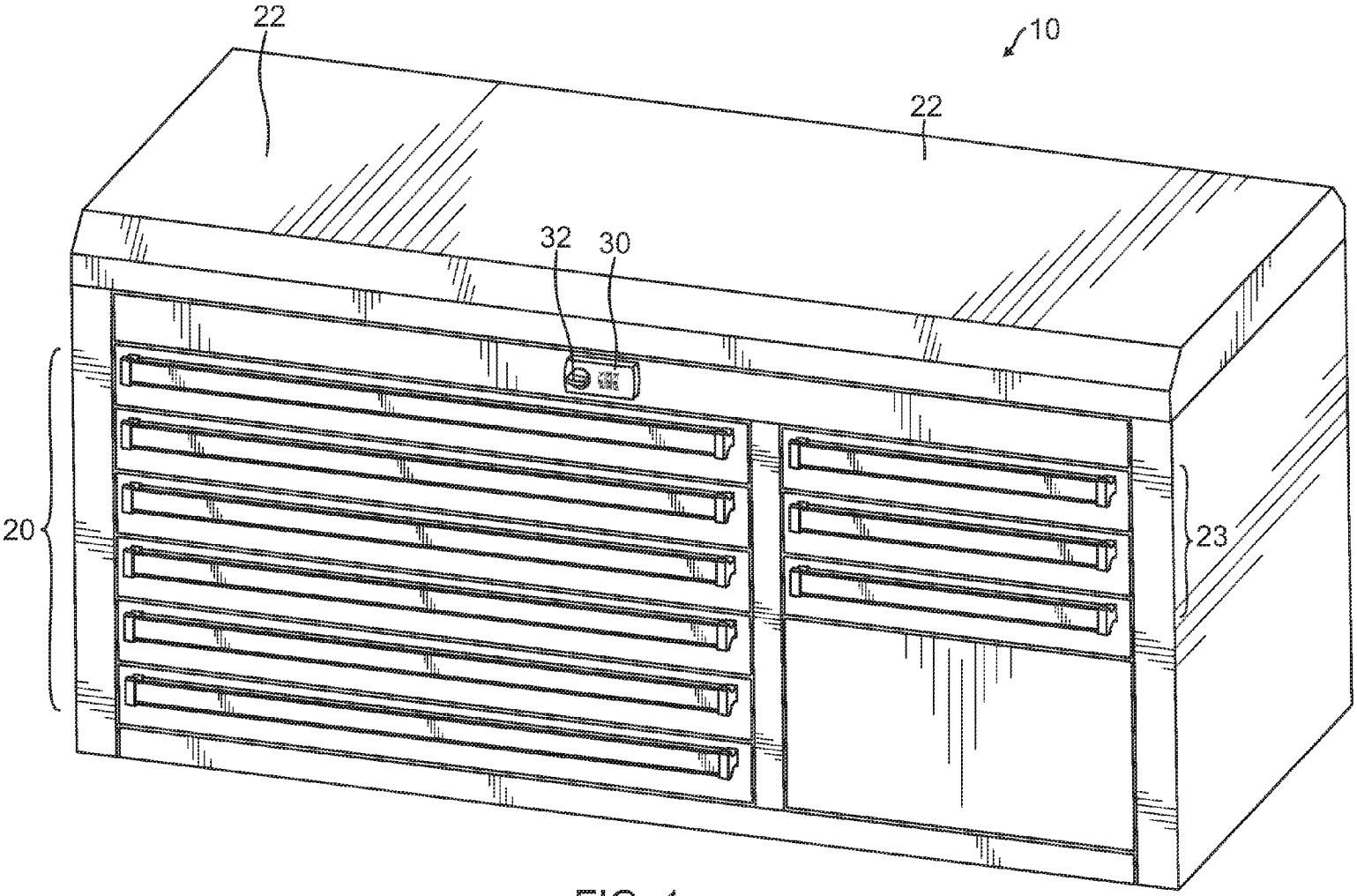
FIG. 1 is a front perspective view of a preferred embodiment of a keyless tool chest with a plurality of drawers closed.
Figure 2:
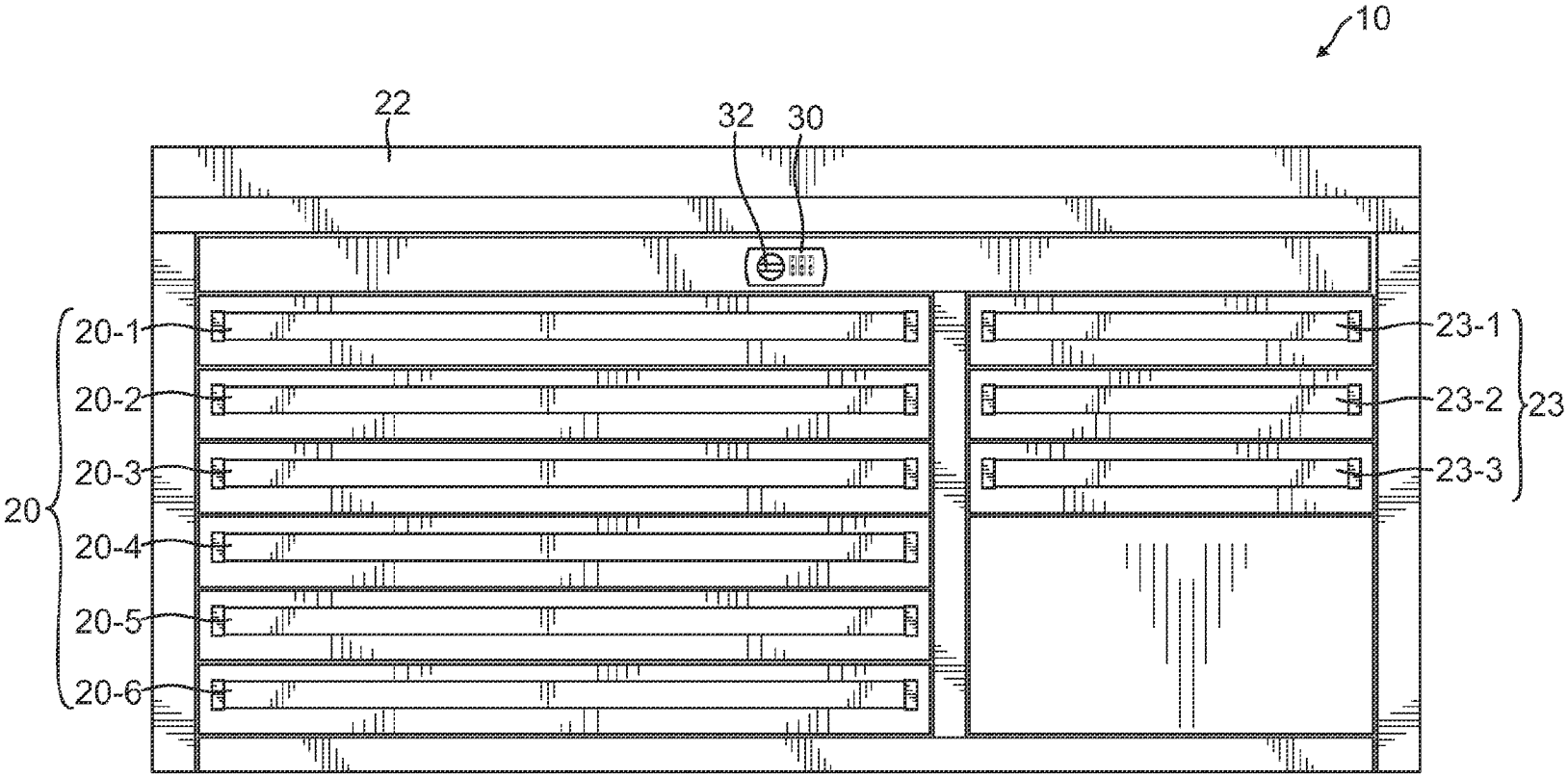
FIG. 2 is a front view of the keyless tool chest with the plurality of drawers closed.
Figure 3:
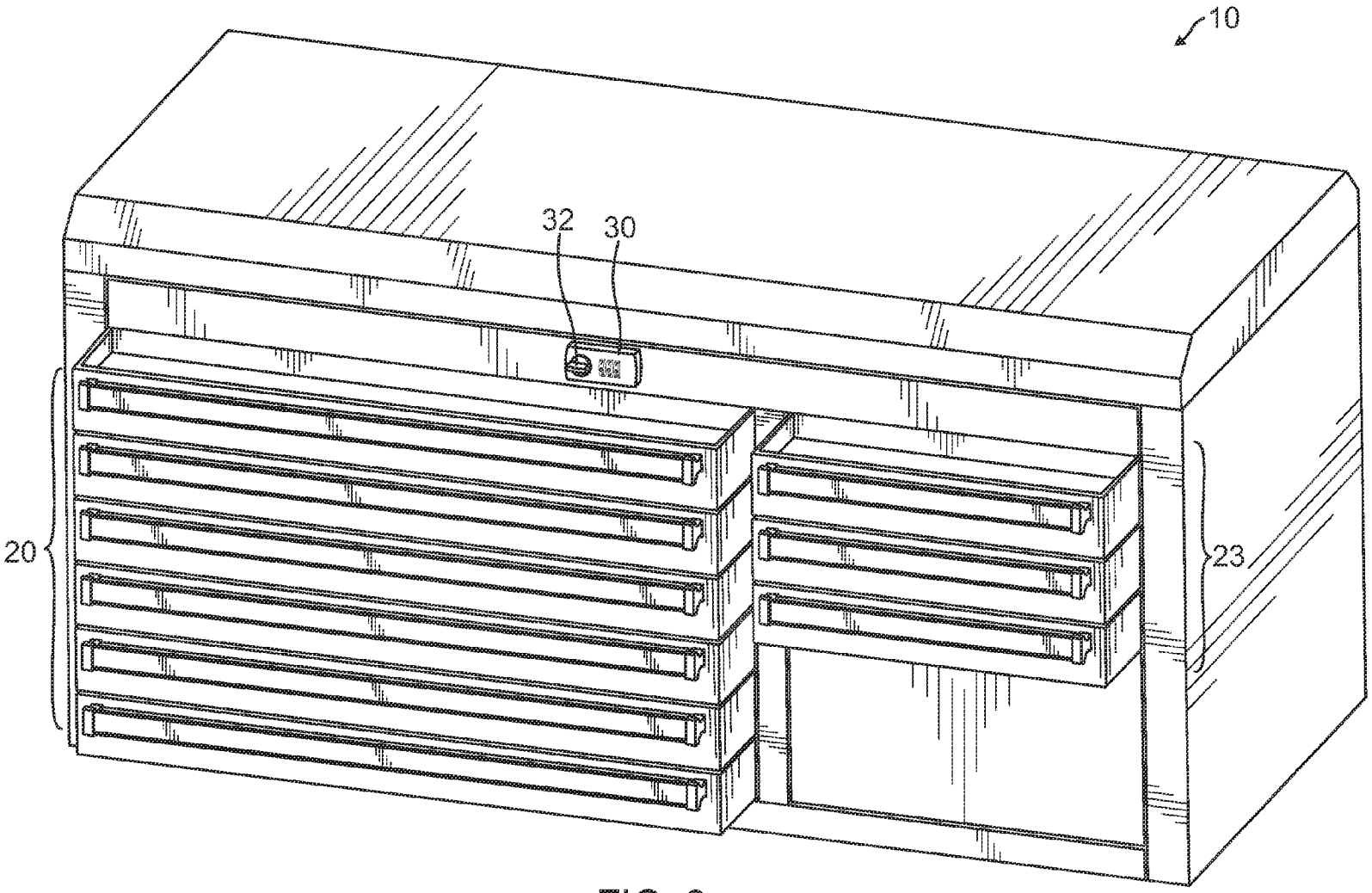
FIG. 3 is a front perspective view of the keyless tool chest with the plurality of drawers open.

FIGS. 1-3 illustrate a general external overview of a preferred embodiment of a keyless locking tool chest, or simply a tool chest, designated by a reference numeral 10. The tool chest 10 may comprise a plurality of left drawers 20, a plurality of right drawers 23, a keyless lock 30 and a turn dial 32. As shown in FIG. 2, each of the plurality of left drawers 20 is identical one from another, and individual left drawer 20 shall be denoted by the suffix "−1," "−2," "−3" and so forth. Similarly, each of the plurality of right drawers 23 is identical one from another, and individual right drawer 23 shall be denoted by the suffix "−1," "−2," "−3" and so forth.

In the default "locked" position, the plurality of left drawers 20 and the plurality of right drawers 23 are "closed" or pushed into the tool chest 10. As shown in FIG. 3, in an "unlocked" position, the plurality of left drawers 20 and the plurality of right drawers 23 are "open" and can be pulled out of the tool chest 10. As will be discussed in further details below, the tool chest 10 can only be unlocked when the right numerical combination is set into the keyless lock.

Figure 4:
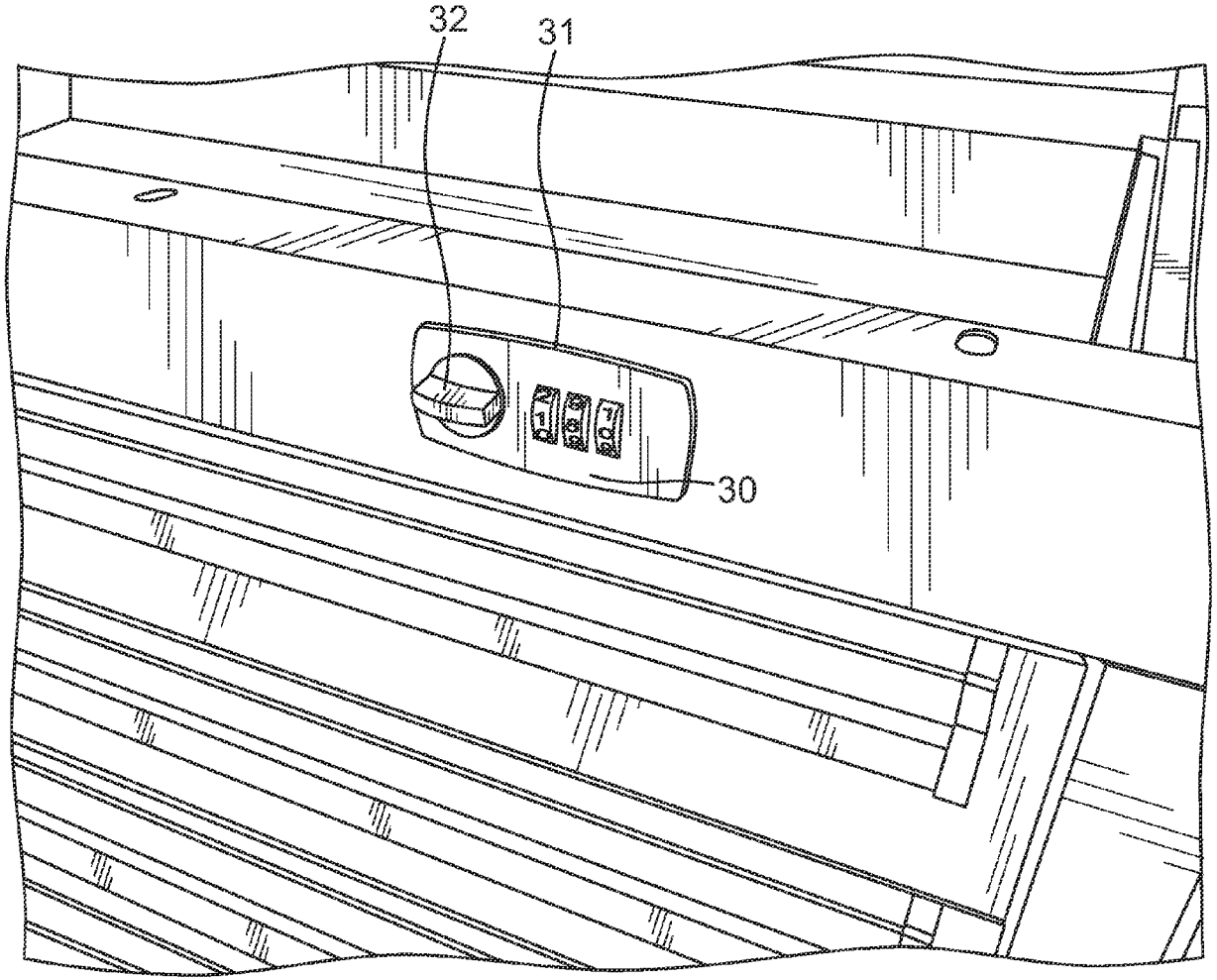
FIG. 4 is a close up perspective view of the keyless lock.

FIG. 4 illustrates a preferred embodiment of the keyless lock 30 and the turn dial 32. In the preferred embodiment, the keyless lock 30 comprises a multiple digit combination lock having a plurality of rotating discs with inscribed numerical notches 31. In the illustrated embodiment, the combination lock 30 preferably comprises a 3-digit roll lock, although lesser or greater digits may be provided. In another embodiment, the keyless lock 30 may comprise an electronic keypad (not shown) wherein a predetermined numerical combination can be entered. The turn dial 32 is rotatable in clockwise and counterclockwise directions when the predetermined numerical combination is set in the keyless lock 30 and the tool chest 10 is in the unlocked position. According to the preferred embodiment, a user can create and reset any personal code combination to operate the keyless lock 30.

Figure 5:
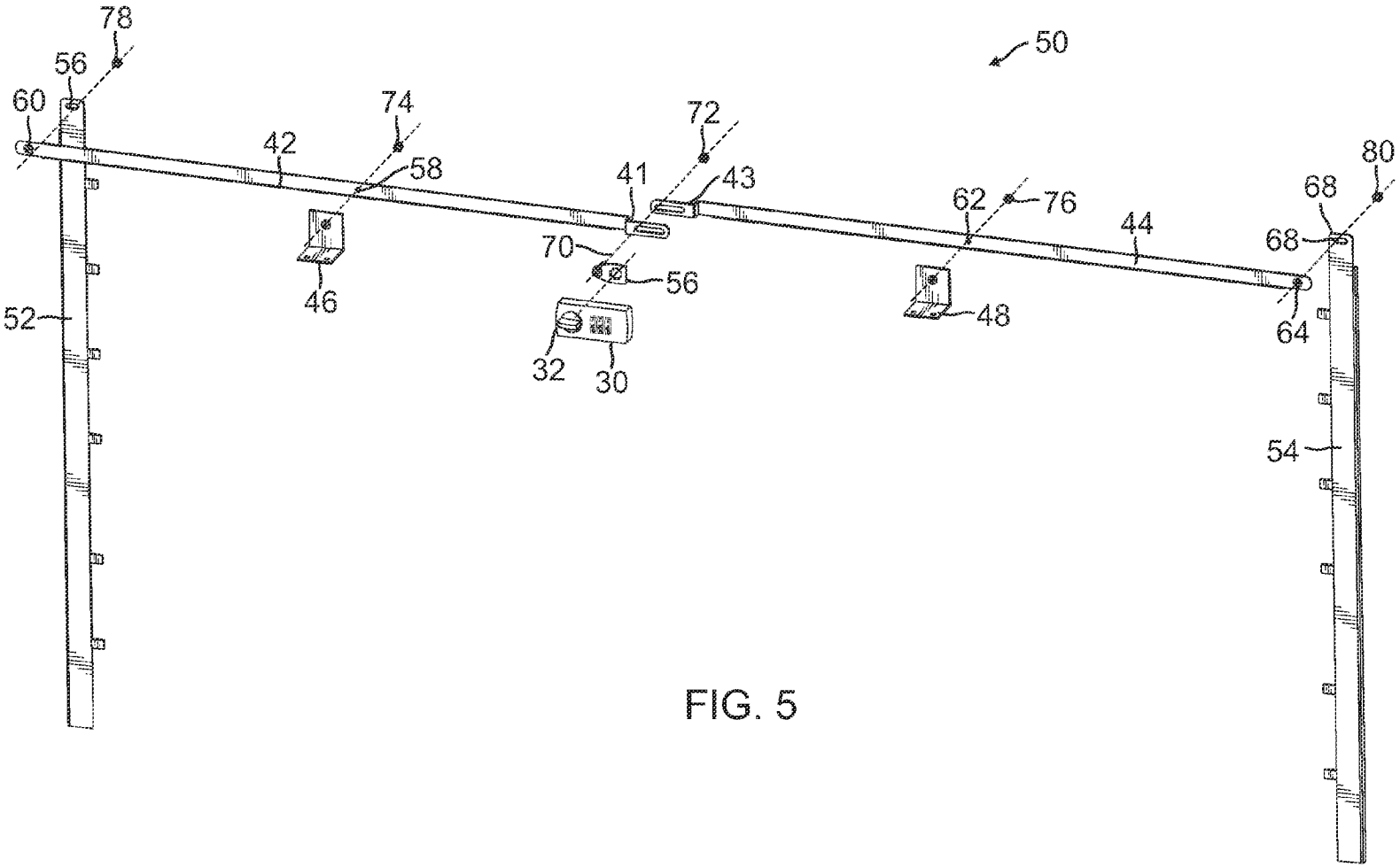
FIG. 5 is an exploded view of a keyless lock and a locking mechanism.
Figure 6:
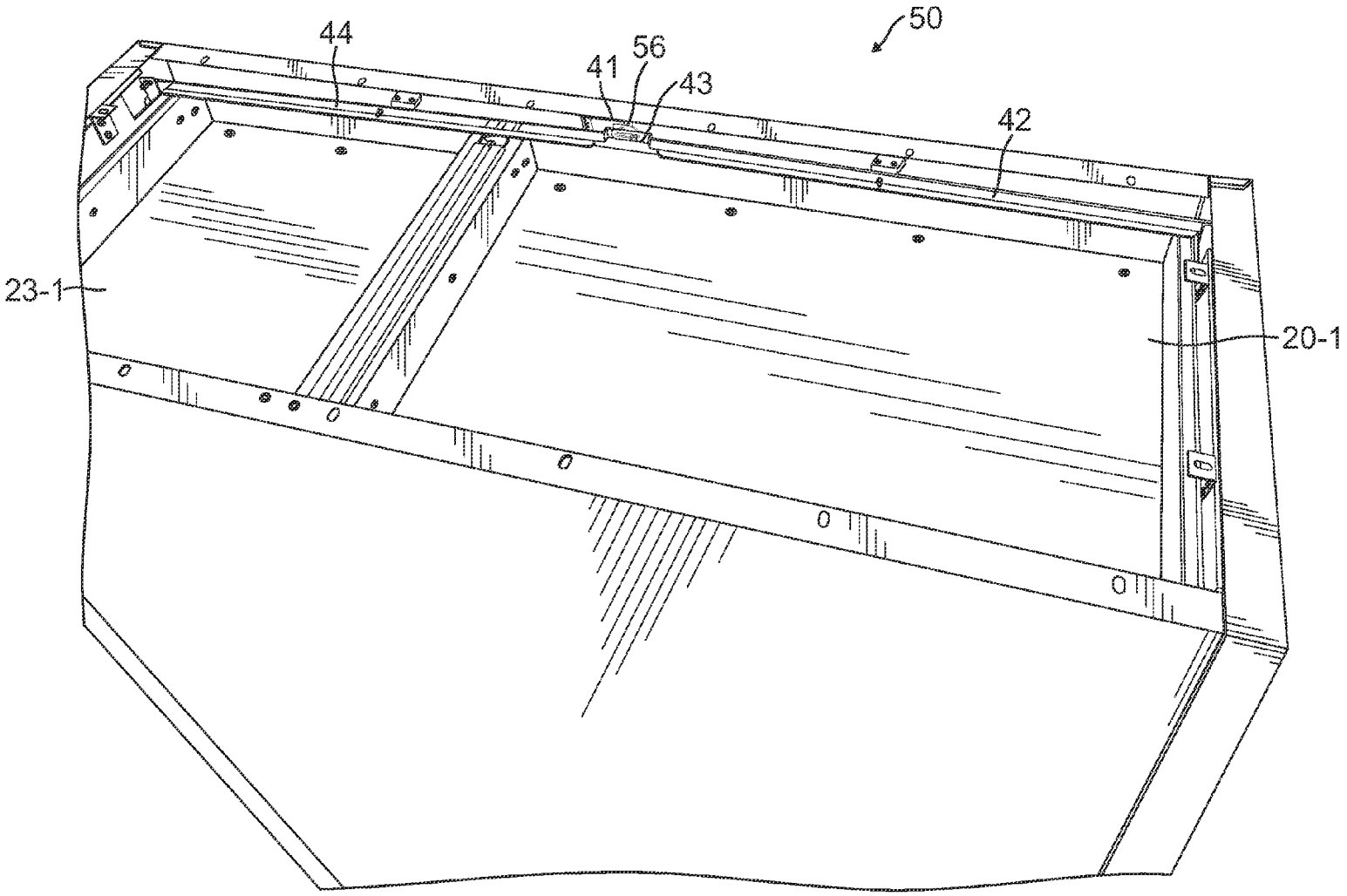
FIG. 6 is a top perspective internal view of the keyless tool chest.

FIG. 5 provides a detailed view of the configuration of the keyless lock 30 and a locking mechanism 50. As shown here, the locking mechanism 50 comprises a left horizontal bar 42, a right horizontal bar 44, a left vertical bar 52, a right vertical bar 54, a center washer 56, a left horizontal bracket 46 and a right horizontal bracket 48. The left horizontal bar 42 comprises a left center opening 41, a left bracket hole 58 and a left corner opening 60. The right horizontal bar 44 comprises a right center opening 43, a right bracket hole 62 and a right corner opening 64. The left vertical bar 52 comprises a left top hole 66 and the right vertical bar 54 comprises a right top hole 68. The center washer 56 comprises a washer opening 70.

In a fully assembled form, the turn dial 32 is internally connected to the keyless lock 30 such that when the correct predetermined combination is set in the keyless lock 30, the turn dial 32 is rotatable in clockwise and counterclockwise directions. The turn dial 32 is tightly secured to the center washer 56 through the washer opening 70 such that when the turn dial 32 is rotated, the center washer 56 is also rotated. Further, the center washer 56 is connected to the left horizontal bar 42 through the left center opening 41 and to the right horizontal bar 44 though the right center opening 43 using a first nut and bolt set 72. The left horizontal bar 42 is secured to the inside portion of the tool chest 10 through the left bracket hole 58 and the left horizontal bracket 46 using a second nut and bolt set 74. The right horizontal bar 44 is secured to the inside portion of the tool chest 10 through the right bracket hole 62 and the right horizontal bracket 48 using a third nut and bolt set 76. The left horizontal bar 42 is further connected to the left vertical bar 52 through the left corner opening 60 and the left top hole 66 using a fourth nut and bolt set 78. The right horizontal bar 44 is further connected to the right vertical bar 54 through the right corner opening 64 and the right top hole 68 using a fifth nut and bolt set 80.

Due to the single connection between the turn dial 32, the center washer 56, the left horizontal bar 42 and the right horizontal bar 44 at the center of the assembly, when the turn dial 32 is rotated, the left horizontal bar 42 and the right horizontal bar 44 move together with the left vertical bar 52 and the right vertical bar 54 to allow the plurality of left drawers 20 and the plurality of right drawers 23 to be pulled out of the tool chest 10.

Figure 7:
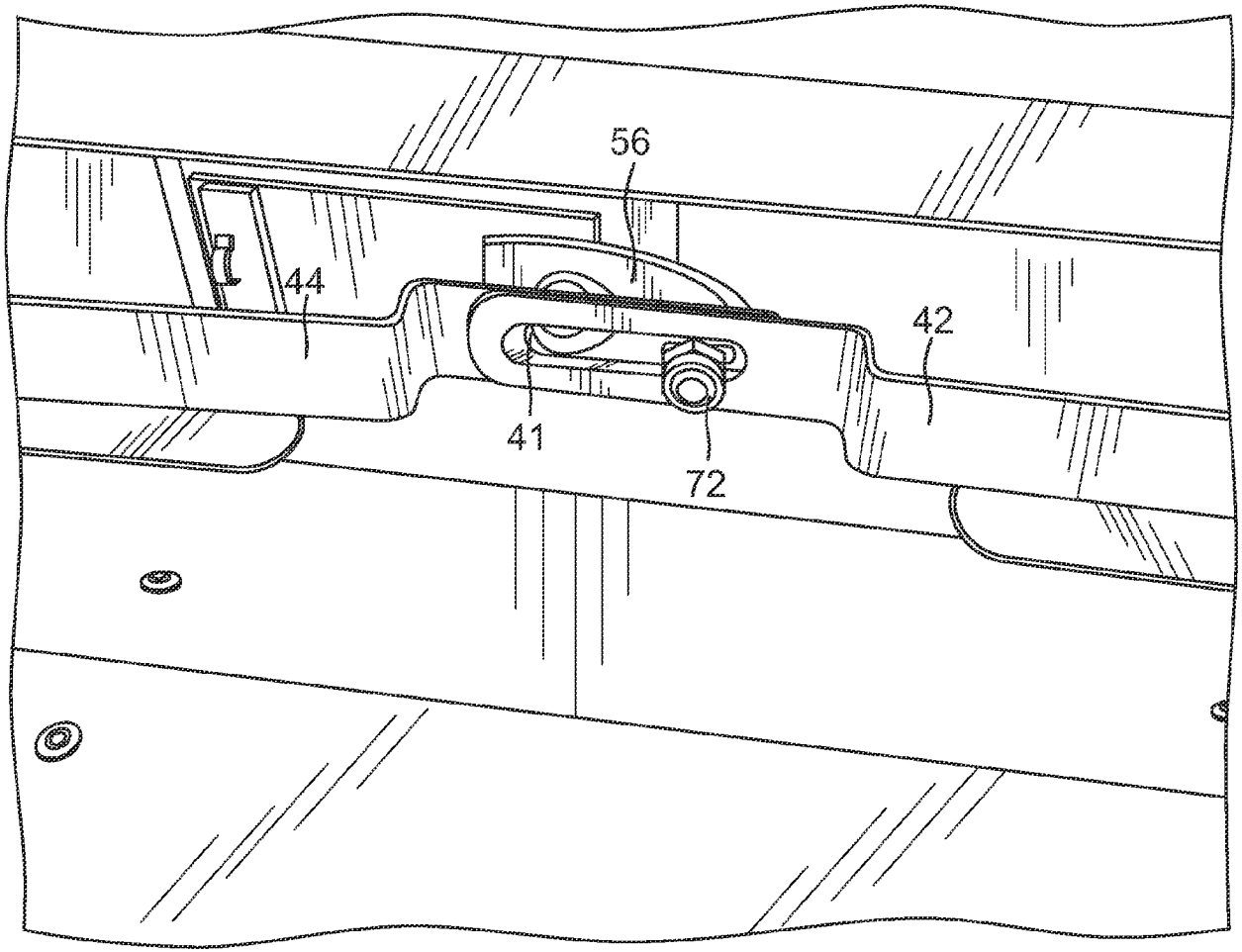
FIG. 7 is a close up view of a center washer connecting a horizontal bar to the keyless lock.
Figure 8:
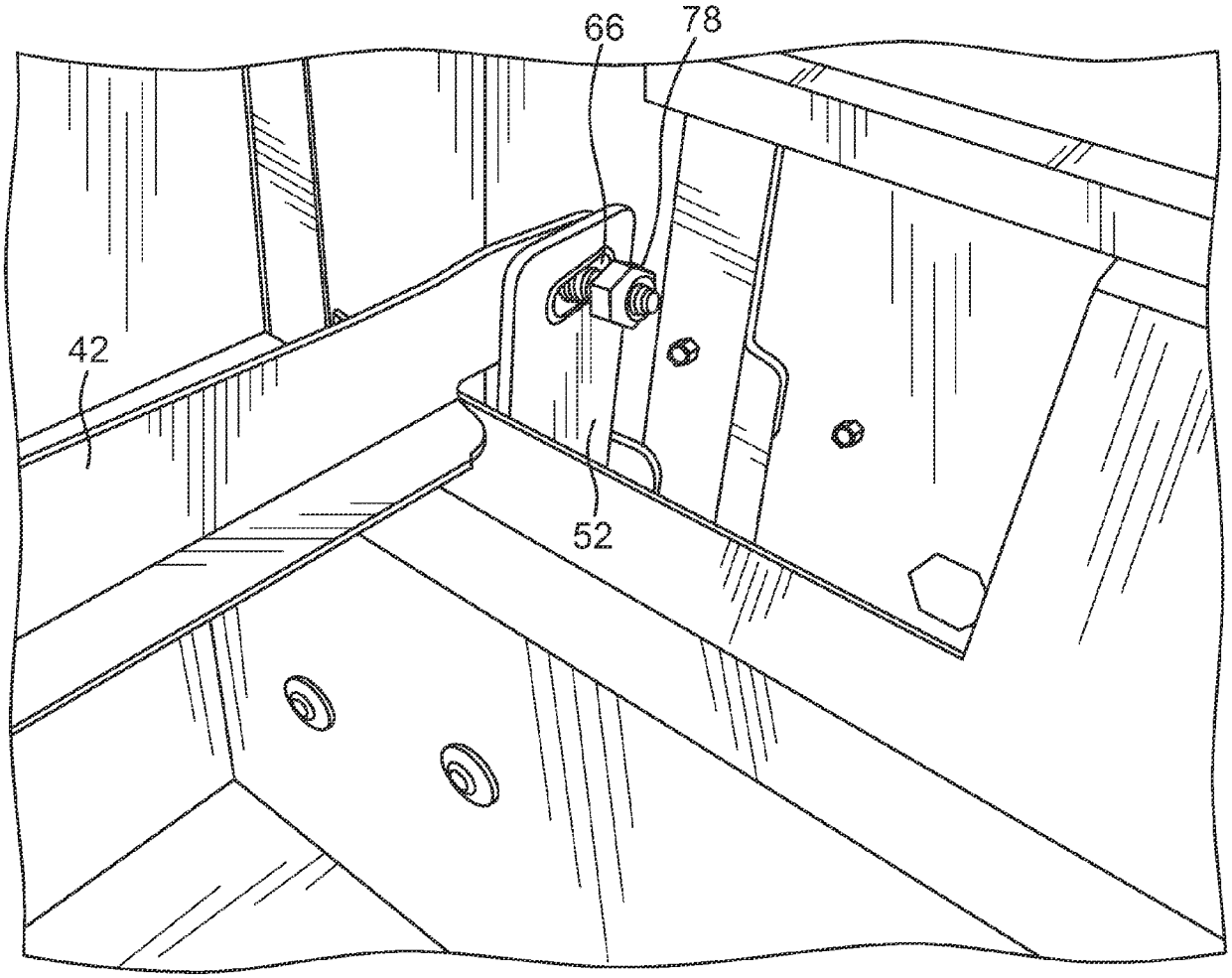
FIG. 8 is a close up internal view of a first corner of the keyless tool chest.
Figure 9:
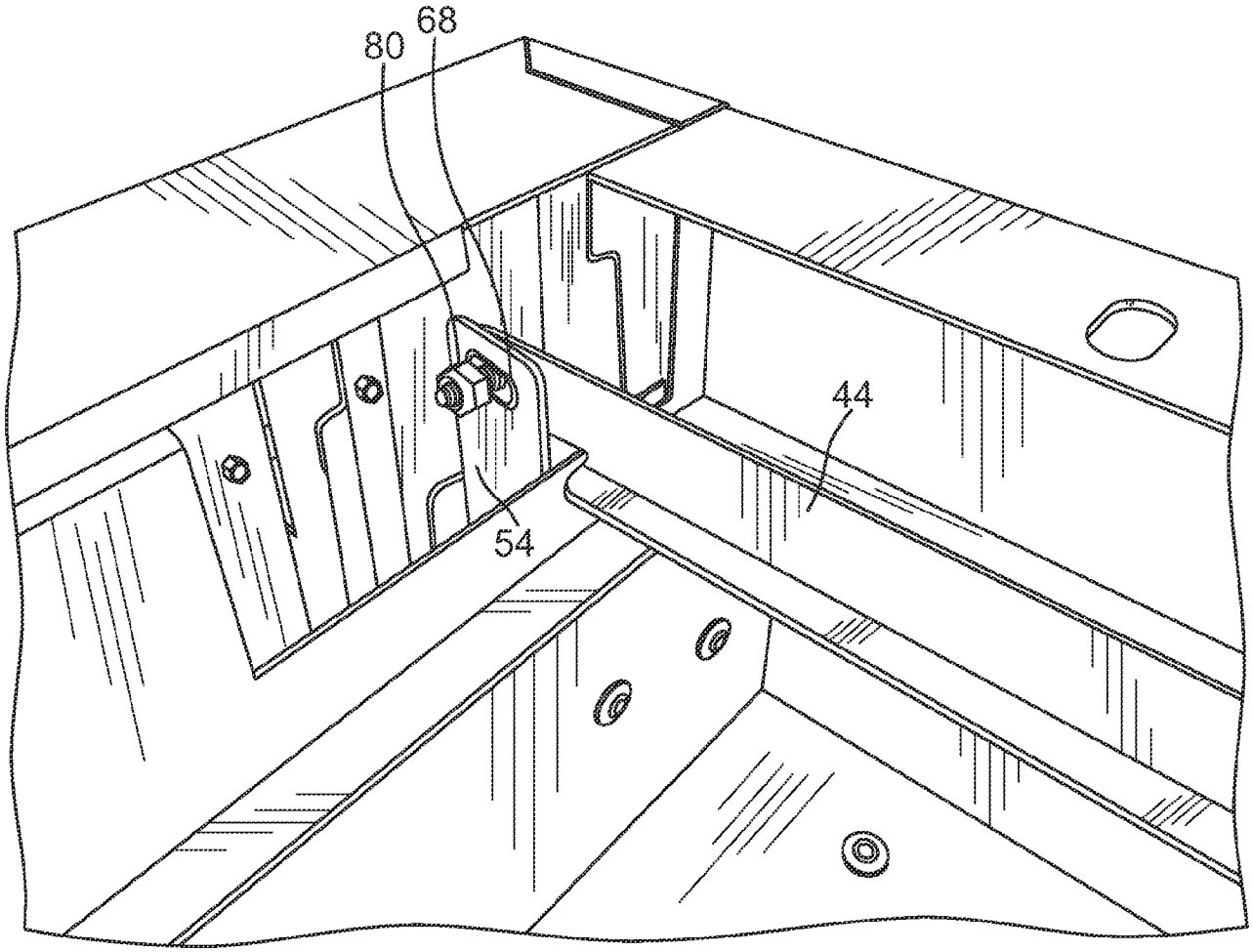
FIG. 9 is another close up internal view of a second corner of the keyless tool chest.

FIGS. 6-9 provide a close up view from the back of the locking mechanism 50, a first left drawer 20-1 and a first right drawer 23-1. As shown in FIG. 7-9, the left center opening 41, the right center opening 43, the left top hole 66 and the right top hole 68 are elongated. In the default locked position, the left horizontal bar 42 and the right horizontal bar 44 are linearly aligned in series. The left vertical bar 52 and the right vertical bar 54 are in a down position, wherein the left vertical bar 52 is in a 90° right angle relative to the left horizontal bar 42 and the right vertical bar 54 is in a 90° right angle relative to the right horizontal bar 44.

Upon setting the correct predetermined numerical combination in the keyless lock 30, the turn dial 32 becomes rotatable in clockwise and counterclockwise directions. Upon turning the turn dial 32 clockwise (as viewed from the front), the center washer 56 rotates 90° in the clockwise direction and the first nut 72 and bolt set slides along the elongated openings of the left center opening 41 and the right center opening 43. Simultaneously, the fourth nut and bolt set 78 in the left connection of the assembly slides along the elongated opening of the left top hole 66, and the fifth nut and bolt set 80 in the right connection of the assembly slides along the elongated opening of the right top hole 68. Moving as a unit, the left horizontal bar 42 and the right horizontal bar 44 become slightly raised, non-linear and angled relative to each other, and the left vertical bar 52 and the right vertical bar 54 become slightly raised as well. In this configuration, the plurality of left drawers 20 and the plurality of right drawers 23 can be pulled out of the tool chest 10. Upon turning the turn dial 32 counterclockwise (as viewed from the front), the center washer 56 rotates 90° in the counterclockwise direction and the first nut and bolt set 72 slides along the elongated openings of the left center opening 41 and the right center opening 43 to its original position. Simultaneously, the fourth nut and bolt set 78 in the left connection of the assembly slides along the elongated opening of the left top hole 66, and the fifth nut and bolt set 80 in the right connection of the assembly slides along the elongated opening of the right top hole 68 to their respective original positions. Moving as a unit, the left horizontal bar 42 and the right horizontal bar 44 become linearly aligned relative to each other once again, the left vertical bar 52 returns to its original down position in a 90° right angle relative to the left horizontal bar 42, and the right vertical bar 54 returns to its original down position in a 90° right angle relative to the right horizontal bar 44.

Figure 10:
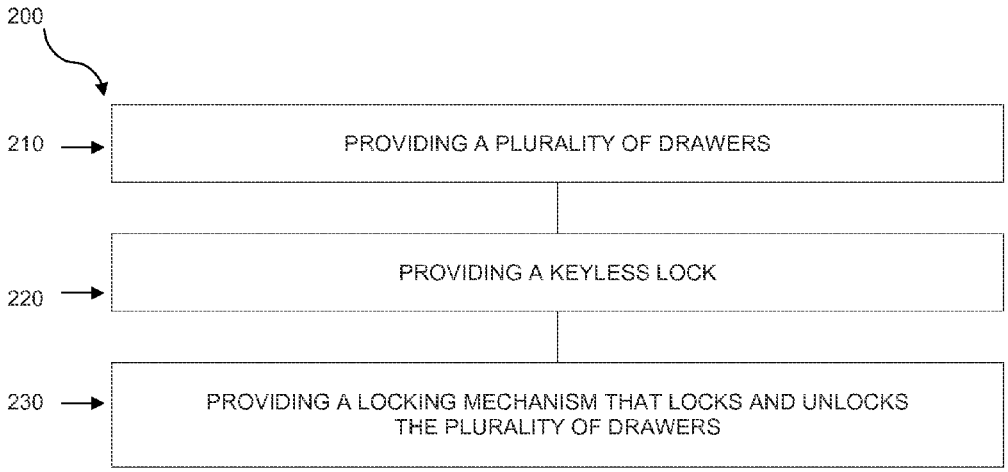
FIG. 10 is a diagram of a preferred method of providing a keyless tool chest.

FIG. 10 illustrates a preferred method 200 of providing a keyless tool chest. The method 200 may comprise a step 210 of providing a plurality of drawers, a step 220 of providing a keyless lock and a step 230 of providing a locking mechanism that locks and unlocks the plurality of drawers.

The step 210 of providing a plurality of drawers may further comprise providing a plurality of left drawers and a plurality of right drawers. In one aspect, the step 210 may further comprise providing an equal number of the plurality of left drawers to the number of the plurality of right drawers. In another aspect, the step 210 may further comprise providing an unequal number of the plurality of left drawers to the number of the plurality of right drawers.

The step 220 of providing a keyless lock may further comprise providing a combination lock having a plurality of rotating discs with inscribed numerical notches. In another preferred method, the step 220 may comprise providing an electronic keypad wherein a predetermined numerical combination can be entered. According to the preferred method, the step 220 may further comprise connecting the keyless lock to a turn dial, wherein the turn dial is rotatable in clockwise and counterclockwise directions when the predetermined numerical combination is set in the keyless lock.

Preferably, the user can create and reset any personal code combination to operate the keyless lock.

The step 230 of providing a locking mechanism that locks and unlocks the plurality of drawers may further comprise connecting a pair of horizontal bars to the keyless lock and the turn dial, and connecting the horizontal bars to a pair of vertical bars at the horizontal bars' opposite ends, wherein the pair of vertical bars is connected to each of the plurality of drawers. The step 230 may further comprise setting the correct numerical combination to allow the turn dial to rotate and the horizontal bars to move together with the vertical bars to allow the plurality drawers to be pulled out of the tool chest.

In one preferred method, the step 230 further comprises securing the turn dial to a center washer such that when the turn dial is rotated, the center washer is also rotated; securing the horizontal bars to the center washer; securing the horizontal bars to the inside portion of the tool chest through bracket holes; and securing the horizontal bars to the vertical bars. Upon setting the correct predetermined numerical combination in the keyless lock, the turn dial becomes rotatable in clockwise and counterclockwise directions such that when the turn dial is turned clockwise, the center washer rotates 90° in the clockwise direction (as viewed from the front), the horizontal bars become slightly raised, non-linear and angled relative to each other, and the vertical bars become slightly raised. In this configuration, the plurality of drawers can be pulled out of the tool chest. Upon turning the turn dial counterclockwise (as viewed from the front), the center washer rotates 90° in the counterclockwise direction and the horizontal bars become linearly aligned relative to each other once again, and the vertical bars return to their original position in a 90° right angle relative to the horizontal bars.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A keyless tool chest comprising:

a plurality of drawers;

a keyless lock;

a locking mechanism connected to the keyless lock that locks and unlocks the plurality of drawers, the locking mechanism including:

at least one horizontal bar having a first end attached via an elongated slot to the keyless lock and a second end;

at least one vertical bar attached to the second end of the at least one horizontal bar via an attachment member inserted through and joining a hole formed in the second end of the at least one horizontal bar and a horizontal slot formed in a first end of the at least one vertical bar; and a horizontal bar bracket disposed between the first end and the second end of the horizontal bar, wherein when the keyless lock is unlocked, the first end of the at least one horizontal bar moves vertically, causing the second end of the at least one horizontal bar to move vertically by pivoting about an axis, the axis extending from the horizontal bar bracket and extending through a hole through the at least one horizontal bar, causing the at least one vertical bar to move vertically to unlock the plurality of drawers.

2. The keyless tool chest of claim 1, further comprising a turn dial connected to the keyless lock and the locking mechanism.

3. The keyless tool chest of claim 1, wherein the keyless lock comprises a combination lock having a plurality of rotating discs with inscribed numerical notches.

4. The keyless tool chest of claim 1, wherein the at least one horizontal bar includes two horizontal bars; and the at least one vertical bar includes two vertical bars, wherein the second ends of each of the two horizontal bars share a common plane with the first ends of each of the two vertical bars.

5. The keyless tool chest of claim 4, wherein the keyless lock is centrally positioned with each of the two horizontal bars extending in opposite directions therefrom with the first ends of each of the two horizontal bars overlapping at their respective connections to the keyless lock.

6. A keyless tool chest comprising:

a plurality of drawers;

a keyless combination lock; and a turn dial connected to the keyless lock;

at least one horizontal bar having a first end attached via an elongated slot to the turn dial and a second end;

at least one vertical bar mechanically and pivotably connected at a pivot axis to the second end of the at least one horizontal bar, the pivot axis formed by an attachment member inserted through and joining a hole in the second end of the at least one horizontal bar and a horizontal slot formed in a first end of the at least one vertical bar; and a horizontal bar bracket disposed between the first end and the second end of the horizontal bar, wherein when the keyless combination lock is unlocked, the first end of the at least one horizontal bar moves vertically due to movement of the turn dial, causing the second end of the at least one horizontal bar to move vertically by pivoting about an axis, the axis extending from the horizontal bar bracket and extending through a hole through the at least one horizontal bar, causing the at least one vertical bar to move vertically to unlock the plurality of drawers.

7. The keyless tool chest of claim 6, further comprising a pair of horizontal bars connected to the turn dial.

8. The keyless tool chest of claim 6, wherein the keyless combination lock further comprises a plurality of rotating discs with inscribed numerical notches.

9. The keyless tool chest of claim 6, wherein the at least one horizontal bar includes two horizontal bars; and the at least one vertical bar includes two vertical bars, wherein the second ends of each of the two horizontal bars share a common plane with the first ends of each of the two vertical bars.

10. The keyless tool chest of claim 9, wherein the keyless lock is centrally positioned with each of the two horizontal bars extending in opposite directions therefrom with the first ends of each of the two horizontal bars overlapping at their respective connections to the keyless lock.

11. A method of providing a keyless tool chest comprising:

providing a plurality of drawers;

providing a keyless lock;

providing a locking mechanism that locks and unlocks the plurality of drawers, the locking mechanism including:

at least one horizontal bar having a first end attached via an elongated slot to the keyless lock and a second end;

at least one vertical bar attached to the second end of the at least one horizontal bar with a bolt passing through a hole in the second end of the at least one horizontal bar and a horizontal slot formed in a first end of the at least one vertical bar; and a horizontal bar bracket disposed between the first end and the second end of the horizontal bar, wherein when the keyless lock is unlocked, the first end of the at least one horizontal bar moves vertically, causing the second end of the at least one horizontal bar to move vertically by pivoting about an axis, the axis extending from the horizontal bar bracket and extending through a hole through the at least one horizontal bar, causing the at least one vertical bar to move vertically to unlock the plurality of drawers.

12. The method of providing a keyless tool chest of claim 11, wherein the step of providing a plurality of drawers further comprises providing a plurality of left drawers and a plurality of right drawers.

13. The method of providing a keyless tool chest of claim 11, wherein the step of providing a keyless lock further comprises providing a combination lock having a plurality of rotating discs with inscribed numerical notches.

14. The method of providing a keyless tool chest of claim 13, further comprising connecting a turn dial to the keyless lock and setting a numerical combination to allow the locking mechanism to lock and unlock the plurality drawers.

15. The method of providing a keyless tool chest of claim 11, wherein the step of providing a keyless lock further comprises connecting the keyless lock to a turn dial, wherein the turn dial is rotatable in clockwise and counterclockwise directions when a predetermined numerical combination is set in the keyless lock.

16. The method of providing a keyless tool chest of claim 15, wherein the step of providing a locking mechanism that locks and unlocks the plurality of drawers further comprises:

securing the turn dial to a center washer such that when the turn dial is rotated, the center washer is also rotated;

securing the horizontal bar to the center washer;

securing the horizontal bar to the inside portion of the tool chest through bracket holes; and securing the horizontal bar to a pair of vertical bars, wherein upon setting a correct predetermined numerical combination in the keyless lock, the turn dial becomes rotatable, the center washer rotates in the same direction as the turn dial, the horizontal bar becomes slightly raised, and the pair of vertical bars becomes slightly raised to allow the drawers to be pulled out of the tool chest.

17. The method of claim 11, wherein the at least one horizontal bar includes two horizontal bars; and the at least one vertical bar includes two vertical bars, wherein the second ends of each of the two horizontal bars share a common plane with the first ends of each of the two vertical bars.

18. The keyless tool chest of claim 17, wherein the keyless lock is centrally positioned with each of the two horizontal bars extending in opposite directions therefrom with the first ends of each of the two horizontal bars overlapping at their respective connections to the keyless lock.

* * * * *